US008689507B2

(12) United States Patent
Chandler

(10) Patent No.: US 8,689,507 B2
(45) Date of Patent: Apr. 8, 2014

(54) WATERPROOFING SYSTEM FOR A BASEMENT OR SIMILAR STRUCTURE

(76) Inventor: Kelly E. Chandler, Evansville, IN (US)

( * ) Notice: Subject to any disclaimer, the term of this patent is extended or adjusted under 35 U.S.C. 154(b) by 139 days.

(21) Appl. No.: 13/199,818

(22) Filed: Sep. 9, 2011

(65) Prior Publication Data

US 2012/0060433 A1 Mar. 15, 2012

Related U.S. Application Data

(60) Provisional application No. 61/403,165, filed on Sep. 10, 2010.

(51) Int. Cl.
*E04F 17/00* (2006.01)

(52) U.S. Cl.
USPC ..... 52/302.3; 52/302.6; 52/287.1

(58) Field of Classification Search
USPC ..... 52/60–62, 97, 169.5, 302.1, 302.3, 52/302.6, 287.1
See application file for complete search history.

(56) References Cited

U.S. PATENT DOCUMENTS

| | | | | |
|---|---|---|---|---|
| 5,765,323 | A * | 6/1998 | Bevilacqua | 52/169.5 |
| 5,771,643 | A * | 6/1998 | Parker | 52/169.5 |
| 2005/0198916 | A1 * | 9/2005 | Janesky | 52/169.5 |
| 2005/0204653 | A1 * | 9/2005 | Matthews | 52/169.5 |
| 2008/0190045 | A1 * | 8/2008 | Janesky | 52/169.5 |

* cited by examiner

*Primary Examiner* — Brian Glessner
*Assistant Examiner* — Patrick Maestri
(74) *Attorney, Agent, or Firm* — Gary K. Price

(57) ABSTRACT

A system for waterproofing a basement or similar structure including a horizontal section disposed on the top surface of the structure's foundation footer, and a vertical section that extends from the horizontal section in communication with the structure's foundation wall. The horizontal section includes a top surface, side walls, and a bottom surface that define a central drainage area, the side walls include lower apertures. The vertical section includes front and back surfaces, the back surface includes an edge having passages in fluid communication with the lower apertures. The vertical section includes an upper flange that protrudes a distance from the back surface such that the lower edge and flange portion abut the interior surface of the foundation wall.

18 Claims, 5 Drawing Sheets

WATERPROOFING SYSTEM FOR A BASEMENT OR SIMILAR STRUCTURE

CROSS REFERENCES TO RELATED APPLICATIONS

U.S. Provisional application for Patent No. 61/403,165, filed Sep. 10, 2010, with title "Waterproofing System for a Basement or Similar Structure" which is hereby incorporated by reference. Applicant claim priority pursuant to 35 U.S.C. Par. 119(e)(i).

Statement as to rights to inventions made under Federally sponsored research and development: Not Applicable

BACKGROUND OF THE INVENTION

1. Field of the Invention

The present invention relates generally to a waterproofing system, and more particularly to a drainage system adopted in conjunction with a foundation wall.

2. Brief Description of Prior Art

A well-known problem in buildings having basements is seepage of water into the basement, especially following periods of heavy precipitation. This seepage frequently accumulates at the floor line of the basement and, if not controlled, can cause substantial damage to the interior basement walls and to the contents of the basement.

This water seepage gets into the basement through cracks in the foundation walls which develop over time. Moreover, porous building materials, such as concrete block, are susceptible to percolation and seepage of water through the building structure itself and into the interior portion of the structure.

There are many approaches known in the art to attempt to prevent water from seeping into or entering a basement structure. One approach is to attempt to block or cover external holes to prevent water from seeping into the foundation. Other attempts involve the use of water proofing compounds such as tars and epoxies which are used to coat the outside of the foundation wall to prevent water seepage.

In any event, the repair of such walls in an established home or other building is extremely difficult. An attempt to repair the inside of a foundation wall is also difficult as such walls may be paneled, painted enhanced, great sums of money are spent in attempting to repair and fix such foundations. The prior art was cognizant of such problems and there exists a number of patents in the prior art which attempt to provide drainage systems, which systems will reduce the possibility of water that seeps into a foundation wall, from damaging the building. Such patents however, specify complicated systems which are extremely difficult to fabricate and extremely difficult to install.

As will be seen from the subsequent description, the preferred embodiments of the present invention overcome shortcomings of the prior art.

SUMMARY OF THE INVENTION

A waterproofing system for a basement or similar structure includes a horizontal section that is disposed on the top surface of the foundation footer and a vertical section that vertically extends from the horizontal section in communication with the foundation wall. The horizontal section is of a generally rectangular configuration and includes a top surface, side walls, and a bottom surface that define a central drainage area. The side walls contain a plurality of apertures which may be randomly or uniformly disposed through the sidewall surfaces. The vertical section includes a front surface and a back surface. The back surface includes a lower edge that outwardly protrudes a distance from the back surface and having a series of passages. The vertical section further includes an upper spacer such as flange portion that outwardly protrudes a distance from the back surface, such that the lower edge and flange portion abut the interior surface of the foundation wall. The front surface of the vertical section defines a ledge that outwardly protrudes from the front surface. The ledge and front surface define an L-shaped spacing that rests on an upper corner of the top surface of the horizontal section.

In application, the series of passages in the vertical section are in fluid communication with the lower apertures in the side wall of the horizontal section. Thus, water can drain through the passages and into the lower apertures in the horizontal section and downward into the central drainage area and to a discharging area.

DESCRIPTION OF THE PREFERRED EMBODIMENT

In accordance with the present invention, a waterproofing system for a basement or similar structure is disclosed. More particularly, the present system described relates to a waterproofing system to be used in conjunction with a foundation wall. Specifically, it will be noted in the following description that the present system discloses an efficient and effective system for controlling the flow of water seepage and moisture at an interface of a subterranean foundation wall, footing and floor. In the broadest context, the system of the present invention consists of components configured with respect to each other so as to attain the desired objective.

Figure 1:
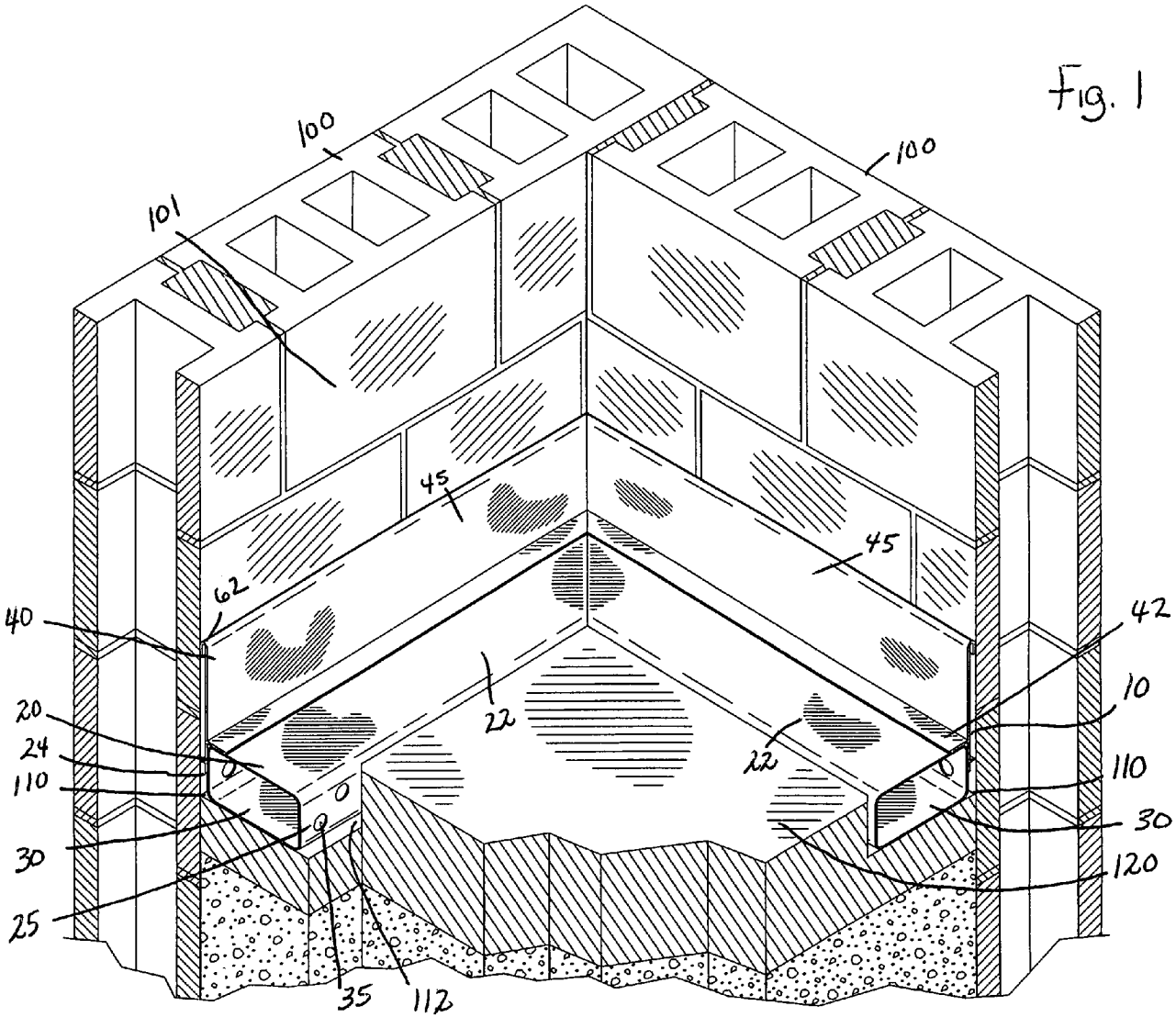
FIG. 1 is a partial sectional view of a typical subterranean structure interface including a foundation wall supported on a footing and an interior floor and a preferred embodiment of the present invention disposed between the wall, footing and floor.

The present invention is now exemplified by a particular embodiment which is illustrated in the accompanying drawings:

The waterproofing system of the present invention, designated as numeral 10, installed in the basement foundation of a structure, is generally shown in FIG. 1. The typical subterranean structural interface that forms the basement or foundation wall is illustrated in FIG. 1 as being constructed of concrete block, but it is to be understood that the waterproofing system 10 of the present invention could be used with a wide variety of construction materials.

The foundation depicted in FIG. 1 conventionally consists of a rectangular configuration having front, back and side walls, the front and side walls shown in FIG. 1 have both been designated by reference numeral 100 for purpose of this explanation. The foundation is constructed in a well known and conventional manner and techniques for pouring and fabricating such foundations from concrete or other materials are well known in the art.

As illustrated, the typical foundation comprises the walls 100 that as previously described, define the rectangular basement area. The wall rests on and is supported by a footer 110, which also has rectangularly disposed portions. The foundation is completed by a floor 120, below ground level, which spans the foundation wall.

Shown located above the footer 110 of the foundation and upwardly extending above the floor 120 is the waterproofing system 10 of the present invention. Essentially, the waterproofing system 10 includes a horizontal section 20 that is disposed on the top surface of the footer 110 and the inner surface of the foundation wall 100, between the foundation wall 100 and the floor 120. The waterproofing system 10 further includes a vertical section 40 that is engaged with the horizontal section 20, as will be further described, and vertically extends from the horizontal section 20 in communication with the foundation wall 100. The waterproofing system 10 and more particularly, the horizontal section 20 consists of a series of drainage structures that are positioned in a channel formed between the basement floor and the foundation wall. The drainage structures 20 are positioned prior to the formation of the foundation or may be located within a channel fabricated in an established home or building by removing concrete about the inner periphery of the basement as depicted in FIG. 1.

In the preferred embodiment, the drainage structures 20 are pitched as positioned so that they are at a slight angle with respect to the basement floor 120 to facilitate the flow of water towards an appropriate disposal location(s) such as a central drain (not shown) or to a sump pump or dry well location (referred to hereinafter as the "discharging area"). While the described disposal of leakage water to a point remote of the foundation is preferred, within the broader aspects of the invention the leakage water could be drained to a sump interiorly of the basement or structure. Such techniques for pitching or angling foundations as well as installation of pipe configurations are well known in the art.

Figure 2:
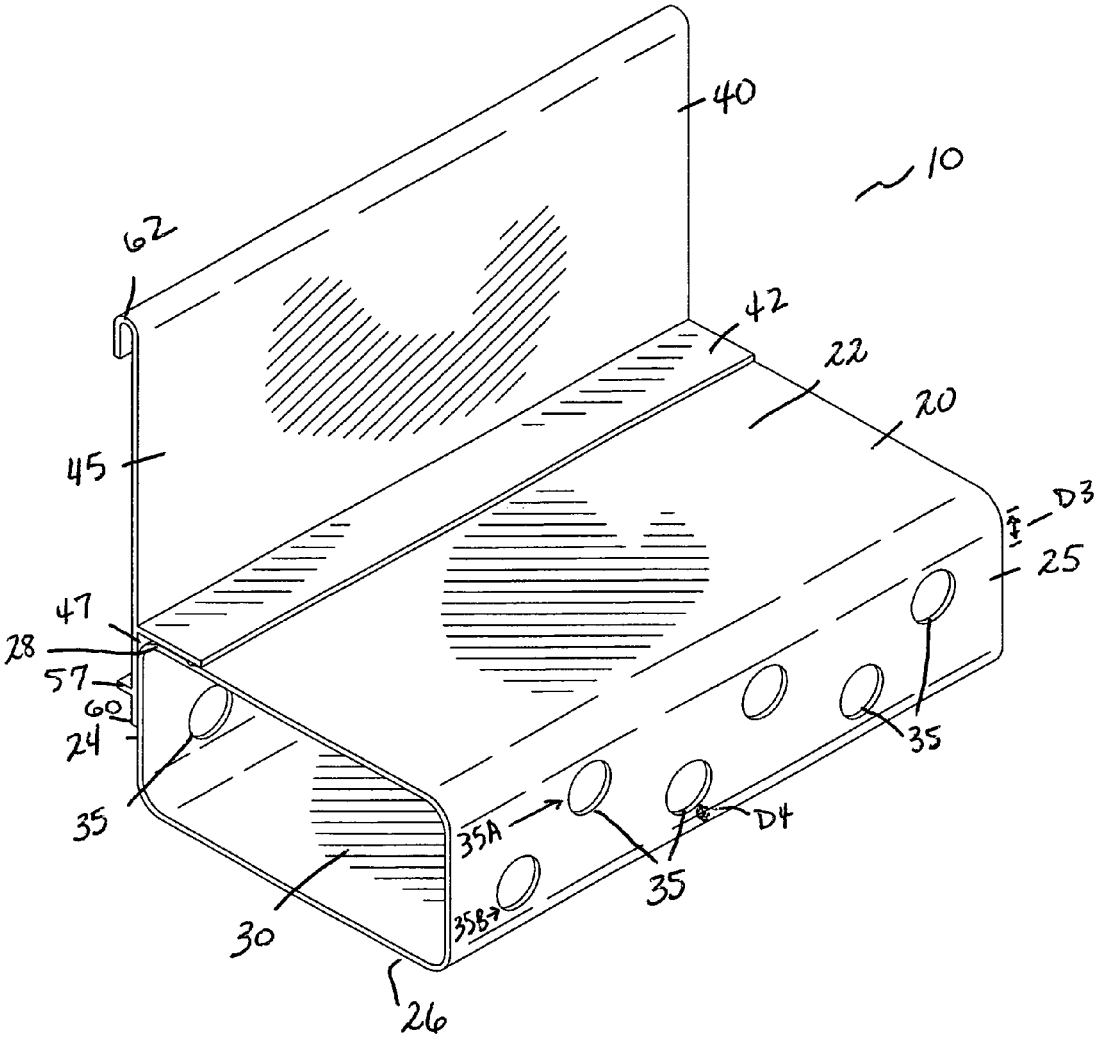
FIG. 2 is a perspective view of the present invention, a waterproofing system for a basement or similar structure.
Figure 3:
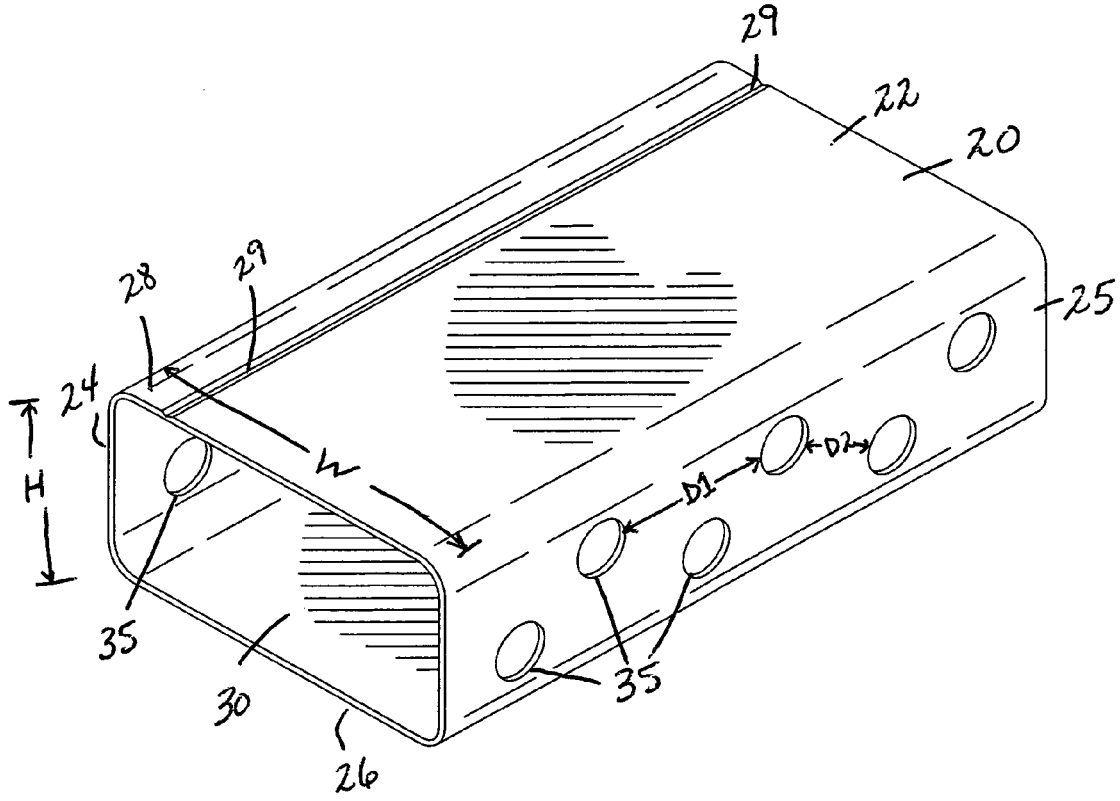
FIG. 3 is a perspective view of the horizontal section of the apparatus shown in FIG. 2.
Figure 4:
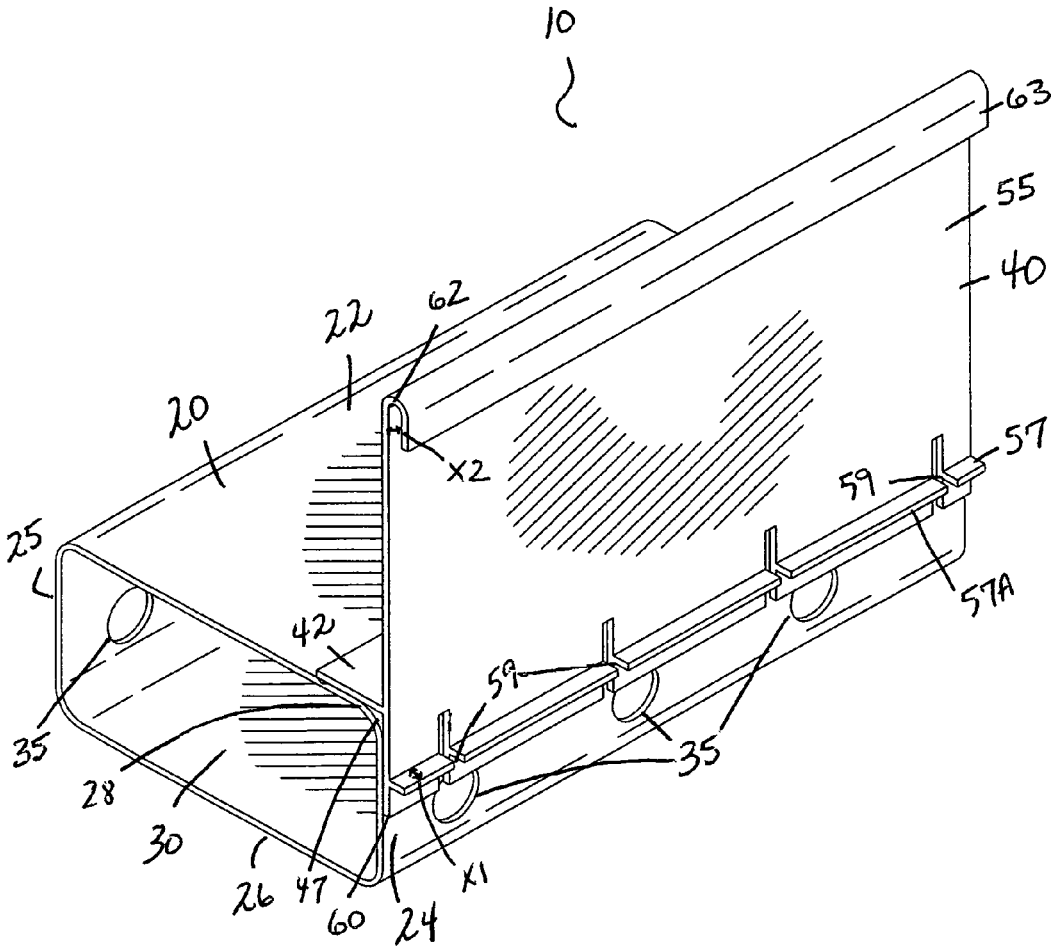
FIG. 4 is a rear view of the apparatus shown in FIG. 2.

Referring to FIGS. 2-4, there is best shown perspective views of the horizontal section 20 which can be employed about the periphery of the foundation as discussed. Essentially, as illustrated, the horizontal section 20 is of a generally rectangular configuration and includes a top surface 22, side walls 24 and 25, and a bottom surface 26 that define a central drainage area 30. The side walls 24 and 25 contain a plurality apertures 35 which may be randomly or uniformly disposed on the surfaces.

As should be understood, any water which seeps down or through the foundation wall 100 will enter those apertures 35 located on the side wall 24, adjacent the foundation wall 100 and be directed through the apertures 35 and into the central drainage area 30 and to a discharging area (not shown). As will be further described, in application, any water which may seep down the interior surface 101 of the wall 100 will be directed by the vertical section 40 to those apertures 35 located on the side wall 24 and through the apertures 35 and into the central drainage area 30 and to a discharging area.

Any leakage flow path that is underneath the footer for example, and not collected by the apertures 35 in side wall 24 abutting the foundation wall 100, will be directed through those apertures 35 located on the side wall 25 and into the central drainage area 30 and thus channelized to a discharging area.

Referring to FIG. 3, in the preferred embodiment, the apertures 35 have a distance "D1" of about 2-3 inches apart and a distance "D2" of about 1 inch apart. It should be noted that the apertures 35 in side wall 24 are preferably positioned and spaced the same as the apertures 35 in side wall 25. Further, in the preferred embodiment, the height "H" of the horizontal section 20 is about 1.75 inches and the width "W" of the horizontal section 20 is about 4 inches. Also as illustrated in FIG. 2, the apertures 35 include an upper row of apertures 35A and a lower row of apertures 35B. The upper row of apertures 35A define a distance "D3" between the apertures 35A and the top surface 22. Similarly, the lower row of apertures 35B define a distance "D4" between the apertures 35B and the bottom surface 26. In the preferred embodiment, in order to add strength to the upper half of the vertical section 20, distance D3 is greater than distance D4.

Figure 5:
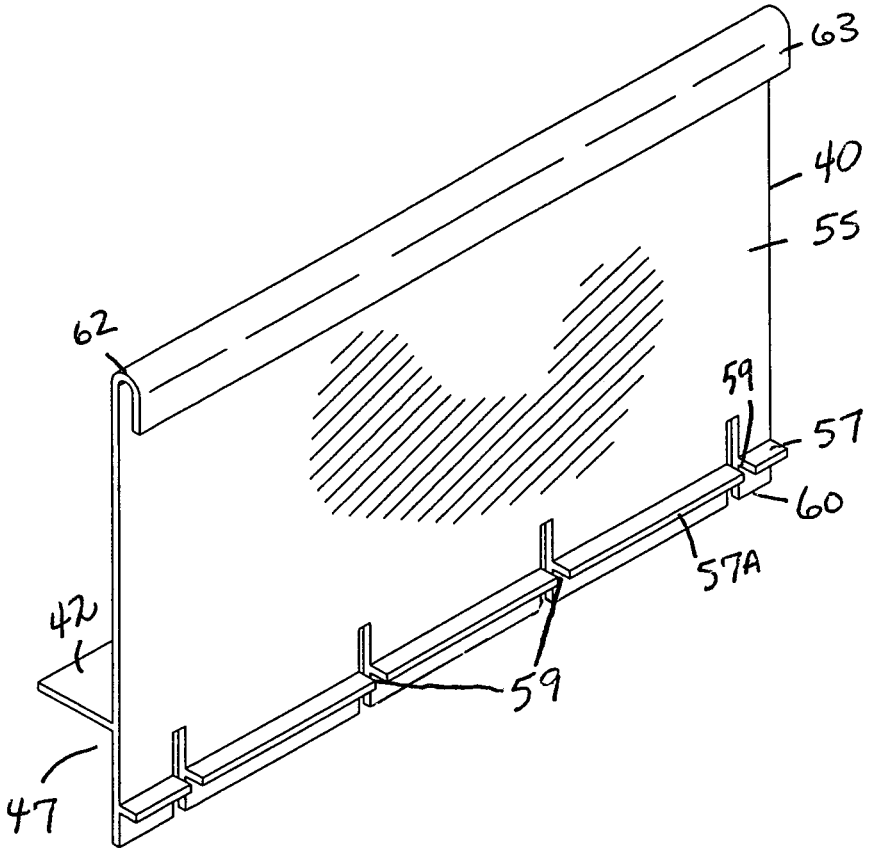
FIG. 5 is a rear perspective view of the vertical section of the apparatus shown in FIG. 2.

Referring to FIGS. 2, 4 and 5, the vertical section 40 generally includes a front surface 45 and a back surface 55. The back surface 55 includes a lower edge 57 that outwardly protrudes a distance X1 from the back surface 55, and a series of passages 59 disposed in the lower edge 57.

The vertical section 40 further includes an upper flange portion 62 that outwardly protrudes a distance X2 from the back surface 55. As shown, the flange portion 62 defines a flange surface 63. In application, an end 57A of the lower edge 57 and flange surface 63 abut the interior surface 101 of the wall 100. As such, the distances X1 and X2 are approximately the same. The lower edge 57 and flange surface 63 cause the remainder of the back surface 55 to be spaced away from the wall 100. As shown, the flange surface 63 is flat and smooth so as to be flush against the basement wall surface 101.

The front surface 45 of the vertical section 40 defines a ledge 42 that outwardly protrudes from the front surface 45. In application the ledge 42 and front surface 45 define an L-shaped spacing 47 (best shown in FIG. 5) that rests on an upper corner 28 of the top surface 22 (best shown in FIG. 3) of the horizontal section 20, which corner 28 is defined by a marking 29.

In application, a channel 112 (see FIG. 1) can be formed around the periphery of a basement floor 120 typically either by forming as the floor 120 is cast or by cutting the channel 112 into an existing floor 120. Once the channel 112 is formed the vertical section 40 and the horizontal section 20 can be placed in the channel 112 such as by adhesive or the vertical section 40 can just rest on the top surface 22 of the horizontal section 20. The series of passages 59 in the vertical section 40 are in fluid communication with the apertures 35 in the sidewall 24 of the horizontal section 20. Thus, water can drain into the passages 59 and then flow into the apertures 35 in the horizontal section 20 and downward into the central drainage area 30 and to the discharging area. As can be seen FIG. 1, the system 10 forms a 90 degree angle between surfaces 45 and 42, this is desirable for appearance, cleaning or further construction.

As described, the waterproofing system 10 of the present invention will drain away water once it seeps into the interior of the basement or other building structure.

Although the description above contains many specificities, these should not be construed as limiting the scope of the invention but as merely providing illustrations of some of the presently preferred embodiments of this invention. Thus the scope of the invention should be determined by the appended claims in the formal application and their legal equivalents, rather than by the examples given.

I claim:

1. An system for waterproofing a basement, said system comprising:

a lower section comprising a top surface, first and second side walls, and a bottom surface that defines a central drainage area, wherein said first and second side walls contain a plurality of lower apertures;

an upright section comprising a front surface and a back surface, said back surface having a lower edge that outwardly protrudes a distance from the back surface and includes a series of passages said upright section further comprising a continuous upper flange portion that outwardly protrudes said distance from the back surface such that the flange portion is in continuous contact with an interior surface of a foundation wall along the entire length of said back surface of the upright section, wherein said front surface of said upright section defines a ledge that outwardly protrudes from said front surface;

wherein said ledge and said front surface define an L-shaped spacing that rests on an upper corner of the top surface of said lower section.

2. The system as recited in claim 1, wherein said passages are in fluid communication with said lower apertures in said first wall such that water can drain through the passages and into the lower apertures in said first wall and downward into the central drainage area and to a discharging area.

3. The system as recited in claim 2, wherein said lower section is disposed on a top surface of the foundation footer and said upright section vertically extends from the lower section in communication with the foundation wall.

4. The system as recited in claim 3, wherein said lower section is of a generally rectangular configuration.

5. The system as recited in claim 4, wherein said lower apertures are randomly disposed on said side walls.

6. The system as recited in claim 4, wherein said lower apertures define an upper row of apertures spaced a first distance from said top surface, and a lower row of apertures spaced a second distance from said bottom surface disposed on said side walls.

7. The system is recited in claim 6, wherein said first distance is greater than said second distance.

8. A system for draining a foundation, said system comprising:

a lower section having a length and comprising a top surface, first and second sidewalls, and a bottom surface that defines a central drainage area, wherein said first and second sidewalls contain a plurality of lower apertures;

an upright section having said length and comprising a front surface and a back surface, said back surface having a lower edge that outwardly protrudes a distance from said back surface and includes a series of passages, said upright section further comprising a continuous upper flange portion that outwardly protrudes said distance from the back surface and forms a continuous contact between said flange portion and an interior surface of a foundation wall along the entire length of the back surface of the upright section.

9. The system as recited in claim 8, wherein said passages are in fluid communication with said lower apertures in said first wall such that water can drain onto said lower edge, through said passages and into the lower apertures in said first wall and downward into the central drainage area and to a discharging area.

10. The system as recited in claim 9, wherein said lower section is disposed in a channel formed in a floor around the periphery of a foundation wall and said upright section vertically extends from the lower section in communication with the foundation wall.

11. The system as recited in claim 9, wherein said lower section is in the shape of a rectangular tube.

12. The system as recited in claim 9, wherein said lower apertures are holes and are formed in both first and second sidewalls.

13. The system as recited in claim 9, wherein said lower apertures include a top row of holes and a bottom row of holes where the bottom row of holes are adjacent to said channel.

14. A system for waterproofing a basement, said system comprising:

a tubular lower section having a length and comprising a top surface, first and second sidewalls, and a bottom surface that defines a central drainage area, wherein said first and second sidewalls contain a plurality of first apertures;

a upright section comprising a back surface, said back surface having a lower edge that outwardly protrudes a distance from the back surface and includes a series of second apertures, said upright section further comprising a continuous upper spacer along the entire length of said back surface of the upright section that outwardly protrudes said distance from the back surface such that the lower edge and spacer contact a surface of a foundation wall, wherein said front surface of said upright section defines a ledge that outwardly protrudes from said upright section;

wherein said ledge and said front surface define an L-shaped spacing that rests on an upper corner of the top surface of said lower section such that a 90 degree corner is formed along the periphery of said wall.

15. They system as recited in claim 14, wherein said second apertures are in fluid communication with said first apertures in said first wall such that water can drain through the second apertures and into the first apertures in said first wall and downward into the central drainage area.

16. The system as recited in claim 15, wherein said lower section is disposed in a channel formed in a floor around the periphery of a foundation wall and said upright section vertically extends from the lower section in communication with the foundation wall.

17. The system as recited in claim 16, wherein said first apertures are holes and are formed in both first and second sidewalls.

18. The system as recited in claim 16, wherein said first apertures include a top row of holes and a bottom row of holes wherein the bottom row of holes are adjacent a bottom surface of said central drainage area.

* * * * *